United States Patent [19]

Kou

[11] Patent Number: 4,850,060

[45] Date of Patent: Jul. 25, 1989

[54] MOLDING PROCESS FOR AUTOMATIC SPRAYING HOT LAVATORY SEAT AND DEVICE PRODUCED THEREBY

[75] Inventor: Chieng Ming Kou, Taipei, Taiwan

[73] Assignee: Chien, Min-The, Taipei, Taiwan

[21] Appl. No.: 8,532

[22] Filed: Jan. 29, 1987

[51] Int. Cl.[4] ..... A47K 3/20; A47K 13/02; B29C 45/14

[52] U.S. Cl. ..... 4/237; 4/447; 4/DIG. 6; 264/263; 264/272.18; 264/273; 264/274; 264/275; 264/317

[58] Field of Search ..... 4/DIG. 6, 447, 237; 264/46.7, 257, 263, 277, 272.18, 273, 275, 317, 274

[56] References Cited

U.S. PATENT DOCUMENTS

| | | | |
|---|---|---|---|
| 1,839,156 | 12/1931 | Lampkin | 4/DIG. 6 |
| 2,600,619 | 6/1952 | Conterno | 4/420.4 |
| 2,997,770 | 8/1961 | Beltz | 264/263 |
| 3,557,264 | 1/1971 | Getz et al. | 264/46.7 |
| 3,578,812 | 5/1971 | Taussig | 264/263 |
| 4,422,190 | 12/1983 | Huang | 4/DIG. 6 |

FOREIGN PATENT DOCUMENTS

| | | | |
|---|---|---|---|
| 72375 | 11/1985 | China . | |
| 2209887 | 4/1980 | Fed. Rep. of Germany | 4/DIG. 6 |
| 2541107 | 8/1984 | France | 4/237 |

*Primary Examiner*—James Lowe

*Attorney, Agent, or Firm*—Panitch Schwarze Jacobs & Nadel

[57] ABSTRACT

A molding process for automatic spraying hot lavatory seats is characterized by directly positioning the hot spraying device composed of juxtaposed electric heat pipe and hot water pipes into a mold for molding the seat body, so that after molding, the seat body directly contains the spraying device in its thick wall.

8 Claims, 3 Drawing Sheets

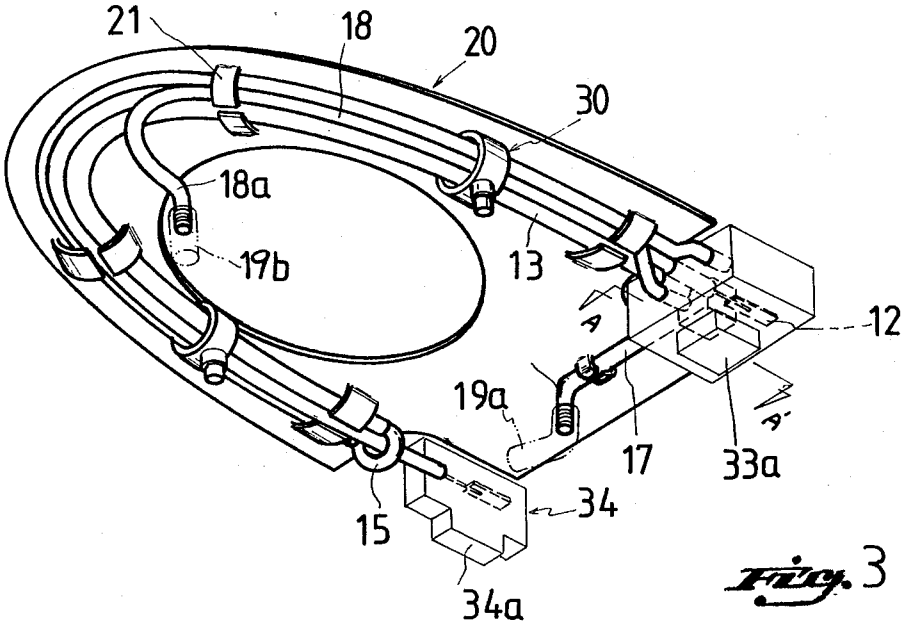
Fig. 3
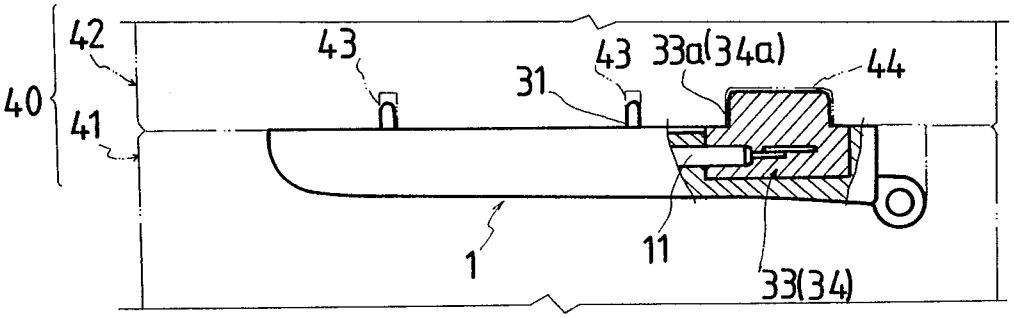
Fig. 4 (A–A')

MOLDING PROCESS FOR AUTOMATIC SPRAYING HOT LAVATORY SEAT AND DEVICE PRODUCED THEREBY

BACKGROUND OF THE INVENTION

The spraying lavatory seat was introduced into Taiwan from Japan. Among the lavatory seats made in Japan, the "hot lavatory seat" and "sawayaka clean" made by Matsushita Electric are examples, wherein an electric heating wire is fixed into the bottom of the lavatory seat with a high cycle process after molding the seat, and the hot water for the sprayer is heated in a tank and led to the spraying position for spray.

The spraying lavatory seat previously designed in Taiwan comprises a hollow water trough casing at the bottom thereof. The hot water in the hot water trough flushing system fills up the trough so as to indirectly maintain the warmth of the lavatory seat. A hot water pipe is installed in the trough and is connected to a nozzle so as to directly spray the hot water.

In the foregoing hot lavatory seat having a water trough, the water trough cover is sealed with glue and will come off when hardened and subjected to water pressure, and the repeated turning up and down of the seat daily quickly results in leaking. This is a serious drawback frequently complained of the users of the seat.

In view of the above, the present inventor has previously designed an improved automatic lavatory seat (unlike the invention shown in the drawings) wherein an upwardly convex wall is provided at the perimeter of both inner and outer edges at the bottom of the seat to form a water channel. A recess is provided in the top surface of the wall to contain a sealing ring to prevent the water from leaking, and an inner cover in engagement therewith forms an enclosed water trough wherein such members as an electric heater, a heat-sensing bar, and a spraying pipe may be installed so as to heat the water therein, heat the seat, and supply a thermostatic spray. This improved device is described in Republic of China (Taiwan) Patent No. 72375.

The preceding improved device has been put into practice and marketed for one year, and is characterized by the "instant" spray of hot water. However, so far as the buildings in Taiwan are concerned, there is always only one water pipe leading from the roof to the ground floor and no pressure reduction valve is installed between adjacent floors. As a result, the water pressure of various floors varies and is extremely high at the lower floors. Since it is difficult to make the corners of the water trough sealing ring leak-proof, the air-tightness of the seats is poor in up to forty percent of the products (i.e., air enters the water trough). The electric heater immersed in the water trough for a long time tends to oxidize (rust) and to erode so that it leads to electric leakage (a factor which has been frequently exaggerated and criticized by Japanese manufacturers). The water trough of the above device is not a conduit with an even cross-section, so that a plurality of dead spaces form therein. These dead spaces retain air to mix with the water to form so-called "enclosed air," which results in a non-smooth spray. Furthermore, the air left in the water trough results in empty burning (i.e., heat sensing without water) of the electric heating pipe, which is dangerous. Otherwise, an air exhaust pipe for the dead space must be provided in the water trough, but this is prohibitive problem for the manufacturing process, resulting in a high cost—slightly cheaper than that of the seats made in Japan.

The Japanese spraying lavatory seat occupies a larger space and has a water heating tank to maintain the water therein at a mean temperature below 40° C. at all times. When draining the water from the heating tank through the nozzle of the conduit, the cold water left in the conduit is sprayed first. This is a frequently criticized drawback.

BRIEF SUMMARY OF THE INVENTION

The mayor object of the present invention is to offer an automatic spraying hot lavatory seat capable of spraying hot water at once by providing a direct heat source without the foregoing drawbacks of electric leakage, enclosed air, and empty burning. Through a prototype manufacture, it has been found that the special manufacturing process of the present invention makes the assembly of the seat extremely simple, the poor operation negligible, the cost considerably low, and the present invention quite popular.

The hot water spraying lavatory seat according to the present invention comprises a molded lavatory seat body containing: an elongated electric heating element embedded in the seat body and extending from one side of a rear portion to a front portion of the seat body and then turning to the other side of the rear portion of the seat body, the heating element having two terminals at the rear portion of the seat body; a water pipe assembly embedded in the seat body, extending along the path of the heating element in the seat body, and including a water inlet end at the rear portion of the seat body and a manifold having a plurality of outlets for spraying hot water from the seat body; and a conductive plate embedded in the seat body, overlying and adjacent to the heating element and the water pipe assembly. The heating element, water pipe assembly and conductive plate are embedded in the seat body during the molding thereof, and the seat body has two accommodating cavities respectively surrounding the terminals of the heating element.

According to the method of the invention, the heating element, water pipe assembly, and conductive plate are juxtaposed, and the seat body is then molded aroung them so that they become embedded in the seat body. The accommodating cavities are formed by covering each of the two terminals with a heat-resistant enclosure while the seat body is molded, and the heat-resistant enclosure is then removed after the seat body has been formed.

BRIEF DESCRIPTION OF THE DRAWINGS

FIG. 3 is an assembled bottom perspective view of the components shown in FIG. 2 and showing the process for molding the space for the electric heating pipe terminals and control valve of a spraying device according to the present invention.

FIG. 4 is a sectional view of the molding process according to the present invention, with the cross-sectional portion of the figure along the line A—A' of FIG. 3.

DETAILED DESCRIPTION OF THE PREFERRED EMBODIMENT

The structure, molding process and function of the present invention can be best described hereinafter in conjunction with the accompanying drawings.

Figure 1:
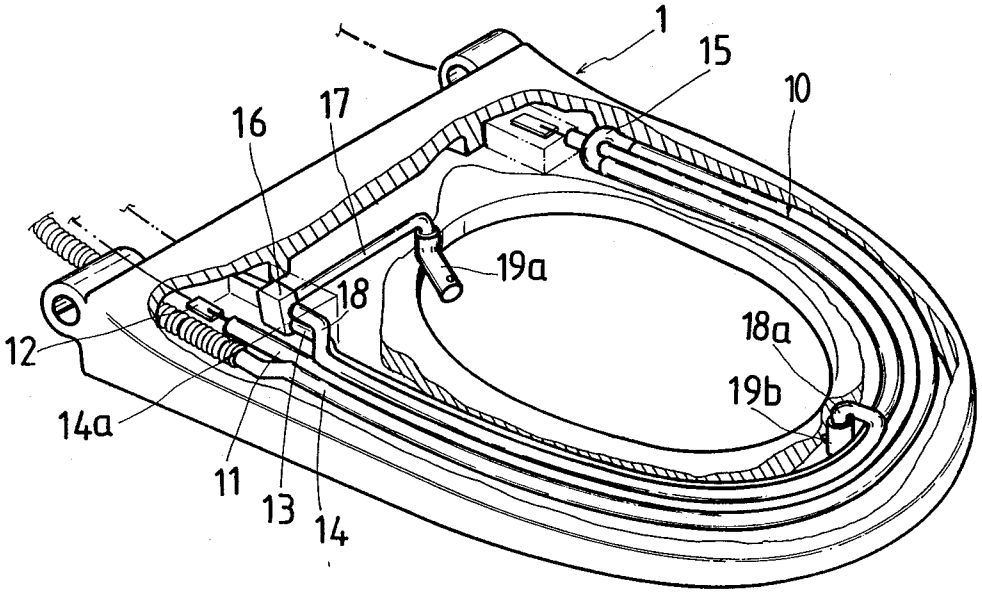
FIG. 1 is a top perspective view, partially broken away, of a lavatory seat according to the present invention.

1. Structure of the Present Invention:

The present invention comprises a hot spraying device 10, a heat conducting plate 20 secured to the hot spraying device as shown in FIG. 3, and a seat body 1 to cover the foregoing members as shown in FIG. 1.

The hot spraying device 10 is provided with an U-shaped electric heat pipe casing 11 in keeping with the shape of the seat body 1 on the left, right and front. The terminal 12 for connecting the two ends of the electric heat pipe 11 projects out of the pipe opening, and the casing 11 is tightly sandwiched between two water conduits 13, 14. Adjoining ends of the water conduits are telescoped with and connected to a pipe connector 15, and the other end thereof 14*a*, operates to open and close two branch pipes 17, 18, respectively, with a control valve 16. One of the branch pipes 17 is designed to extend conduit 13 to nozzle 19*a* at the tail part of the seat body 1, and the other branch pipe 18 tightly contacts casing 11, so designed to maintain the required heat and to extend conduit 13 to a front nozzle 19*b* at the front end of the seat body 1. The opening at the other end of conduit 14 is a water inlet, so that the water-feeding conduit 14 tightly contacts electric heat casing 11. When feed water of normal temperature is led to nozzles 19*a*, 19*b*, its temperature has been raised to a suitable degree of 35° C. to 40° C., and the water stored in the conduits 13, 14 is steadily maintained at a suitable spraying temperature so as to heat the lavatory seat.

The heat conducting plate 20 is molded in line with the shape of the surface of the upper part of seat body 1, which corresponds to the shape of casing 11. Approximately vertically projecting clamping members 21 are provided at positions along conduits 13, 14 so as to clamp the foregoing pipe lines 11, 13 and 14 and the accessory branches 17, 18. The various pipe lines and heat conducting plate are preferably made of copper, aluminum or other metals with good heat conductivity for mutually conducting heat through tight and close contact with each other or through integrated drawing of the conduits.

Figure 2:
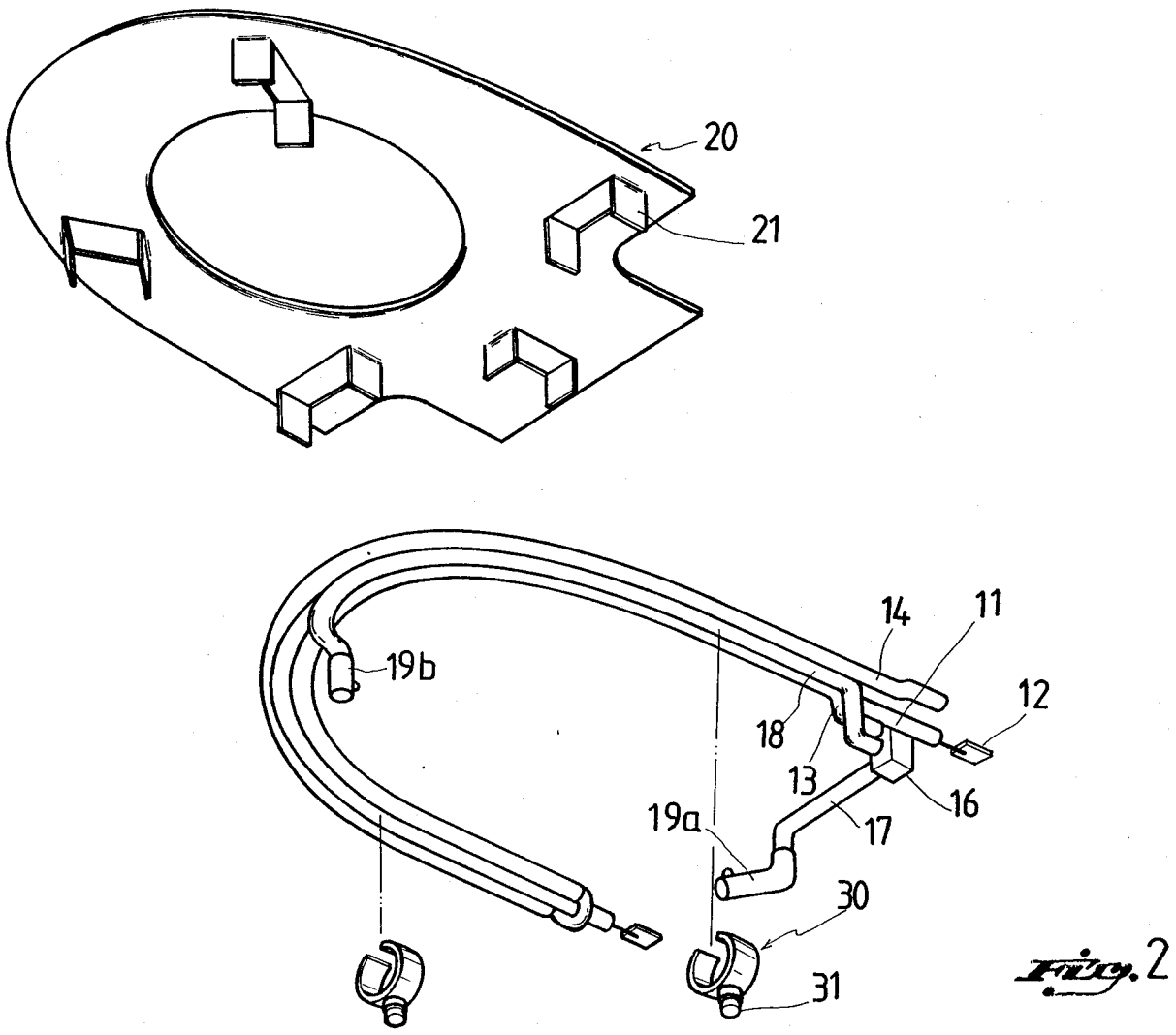
FIG. 2 is an exploded bottom perspective view showing various components of a lavatory seat according to the present invention.

2. Molding Process of the Present Invention:

As shown in FIG. 2, preliminary procedures for molding the seat body 1 of the present invention are disclosed as follows:

A plurality of snap rings 30, which should be made of the same material as that of seat body 1, are used to clamp the hot spraying device 10 including various assembled conduits and control valve in advance in the given shape. A small diameter cylinder 31 is provided on the outer perimeter of snap ring 30 so as to be insertable in recesses 43 in bottom mold 42 of seat body mold 40 (as shown in FIG. 4) and to fix the device 10 to the mold. The heat conducting plate 20 may be clamped to the juxtaposed planes of the conduits of device 10 beforehand.

As shown in FIG. 3, as mentioned above, the water inlet, one of the terminals 12 of the electric heat pipe, and the control valve are provided at a corner of the rear end of the seat body 1. Various projecting ends of these components are covered with gypsum 33, whereby the gypsum fills the mold to the required size and shaped of the corner at the rear end of the seat body. The other terminal is also covered with gypsum 34. After the gypsum 33, 34 is molded, projecting tenons 33*a*, 34*a* are available to be fixed into mortise 44 in mold 42 as shown in FIG. 4.

The molding operation of the seat body 1 as a whole includes these steps: (1) to assemble conduits 11, 13, 14 and heat conducting plate 20; (2) to fill in the gypsum 33, 34; (3) to insert tenons 33*a*, 34*a* and each projecting cylinder 31 on snap rings 30 into the respective mortises in the mold; (4) to mold the seat body 1 with integrated upper and lower molds to cover the hot spraying device 10 therein; (5) to cut off projecting cylinders 31 on snap rings 30; (6) to crush the gypsum 33, 34; and finally (7) to blow out the gypsum chips therefrom with an air nozzle so that the projecting connecting ends of the various members are exposed.

The projecting vertical ends 17*a*, 18*a* of the foregoing branch water pipes 17, 18 are directly inserted in holes (not shown) in the mold so that after seat body 1 is molded, the ends 17*a*, 18*a* may project out of the bottom surface of the seat body 1 and may be threaded to directly lock into nozzles 19*a*, 19*b*.

A control device, such as a heat sensor, may be directly clamped at end portions of the conduits with good heat conductivity for direct heat testing. Various projections, such as electric heat pipe terminals, water feeding pipe and control valve, may be simply installed in an external control box. It is not necessary to describe these control devices in detail, since they are not included in the scope of claims of the present invention.

3. Functions of the Present Invention:

The present invention has achieved the following improvements:

(1) No electric leakage: Because the electric heat pipe is installed in casing 11, but is not directly immersed in water and even the air circulation is negligible, it does not tend to rust.

(2) Integrated manufacturing process simplification: The present invention may be put on an extensive production line to first assemble such hot spraying devices as conduits and electric heat pipes, although additional steps are required for extrusion molding. Furthermore, the following leak-proof operations are eliminated: (a) to fill up gaps and holes with silica gel for leak-proofing, (b) to use water trough sealing rings which are a waste of time, and (c) to use self-tapping screws on the inner cover for tightness.

(3) Considerably increasing the economic safety, effectiveness and competitive ability: The molded water pipe line of the present invention is smooth and easy to be sealed without any enclosed air, empty burning, or limitation on water pressure, but with satisfactory air tightness under testing. The rejection rate due to poor performance is approximately zero. It is estimated that the cost can be lowered by more than two fifths.

(4) It is characterized by spraying hot water at once: The conduits 13, 14 and branch pipes 17, 18 extend in tight contact with electric heat pipe casing 11 and heat conducting plate 20, and are entirely wrapped in the hot seat body 1, so that water stored at the end portions of the pipe lines can be kept in a state of warmth.

I claim:

1. A hot water spraying lavatory seat comprising:

a molded lavatory seat body;

an elongate electric heating element embedded in the seat body and extending from one side of a rear portion to a front portion of the seat body and then turning to the other side of the rear portion of the seat body, the heating element having two terminals at the rear portion of the seat body;

a water pipe assembly embedded in the seat body, extending along the path of the heating element in the seat body, and including a water inlet end at the rear portion of the seat body and a manifold having a plurality of outlets for spraying hot water from the seat body; and a conductive plate, embedded in the seat body, overlying and adjacent to the heating element and the water pipe assembly;

the heating element, the water pipe assembly, and the conductive plate having been embedded in the seat during the molding thereof, and the seat body having two accommodating cavities respectively surrounding the terminals of the heating element.

2. A lavatory seat as claimed in claim 1, wherein the water pipe assembly is provided with valve means, associated with the manifold, for controlling the outlet of water.

3. A lavatory seat as claimed in claim 1, wherein the underside of the conductive plate has clamping members at intervals for clamping the heating element and the water pipe assembly.

4. A lavatory seat as claimed in claim 1, wherein the water pipe assembly includes first U-shaped water pipe and a second U-shaped water pipe on two sides of the heating element, and a connecting tube having two ends respectively connected to the water pipes at one side of the rear portion of the seat body, the first water pipe having a water inlet end to be connected to a water supplying pipe at the other side of the rear portion of the seat body, and the second water pipe having at the said other side of the rear portion of the seat body an outlet end.

5. A lavatory seat as claimed in claim 4, wherein the manifold is connected to the said outlet end of the second water pipe and has at least two branch pipes.

6. A lavatory seat as claimed in claim 1 wherein the manifold has a water outlet at the rear portion of the seat body and a water outlet at the front portion of the seat body.

7. A method of making a hot water spraying lavatory seat which includes:

a molded lavatory seat body;

an elongated electric heating element embedded in the seat boby and extending from one side of a rear portion to a front portion of the seat body and then turning to the other side of the rear portion of the seat body, the heating element having two terminals at the rear portion of the seat body;

a water pipe assembly embedded in the seat body, extending along the path of the heating element in the seat body, and including a water inlet end at the rear portion of the seat body and a manifold having a plurality of outlets for spraying hot water from the seat body; and a conductive plate, embedded in the seat body, overlying and adjacent to the heating element and the water pipe assembly; the method comprising juxtaposing the heating element, the water pipe assembly, and the conductive plate, providing two accommodating cavities respectively surrounding the terminals of the heating element, and molding the seat body around the heating element, the water pipe assembly, and the conductive plate so that they become embedded in the seat body, but without the molding material of the seat body entering said cavities.

8. A method as claimed in claim 7, wherein accommodating cavities are formed by covering each of the two terminals with a heat-resistance enclosure while the seat body is molded and then removing the heat-resistant enclosure after the seat body has been formed.

* * * * *